United States Patent [19]

Guzzi

[11] 3,981,101

[45] Sept. 21, 1976

[54] WINDOW CONSTRUCTION

[75] Inventor: Anthony Guzzi, Finleyville, Pa.

[73] Assignee: G & S Metal Products Inc., Pittsburgh, Pa.

[22] Filed: Oct. 6, 1975

[21] Appl. No.: 619,788

[52] U.S. Cl. ..... 49/162; 49/188; 49/195

[51] Int. Cl.[2] ..... E05D 15/22

[58] Field of Search ..... 49/162, 163, 164, 177, 49/188, 195

[56] References Cited

UNITED STATES PATENTS

| | | | |
|---|---|---|---|
| 822,516 | 6/1906 | Flaschberger et al. | 49/162 |
| 2,201,105 | 5/1940 | Fabriani | 49/188 |
| 2,584,684 | 2/1952 | Etling | 49/177 |
| 2,678,477 | 5/1954 | Russell | 49/177 X |
| 2,785,444 | 3/1957 | Bender | 49/177 X |
| 3,890,741 | 6/1975 | Johnson et al. | 49/177 X |

*Primary Examiner*—William H. Schultz
*Attorney, Agent, or Firm*—Paul Bogdon

[57] ABSTRACT

A window construction having slidable and swinging hinged sashes is disclosed. The pivot arrangement for each sash is constructed for swinging of the sash about a vertical axis. Each sash is usually confined within the frame of the window by a pressure urged sash balance. The sash balance is constructed so that the sash may be moved against the sash balance to position it for swinging away from the frame. A removable T-shaped locking element is received in a channel provided in the jamb adjacent the pivot arrangement of the sashes. One member of the pivot arrangement is disposed within the jamb and has a vertical pivot pin formed thereon. The other member of the pivot arrangement receives one edge of the window pane and has a receptical complementary in shape to the pivot pin. The inner member of the pivot arrangement has a tab portion which cooperates with the locking element to keep the sash secured to the frame. Removing the locking element permits removal of the entire sash from the frame.

9 Claims, 9 Drawing Figures

10
20
16
20a
117
110a
118
12
102
103
110
22a
110b
22
18a
130
83
38
85
40
18
32
14
28
42
50
119
44
23
23a 16
10
20
117
110a
110b
118
83
III
III
12
130
38
85
102
84
105
103
68
40
90
22
14
78
74
50
52
42
18
44
119
32
23

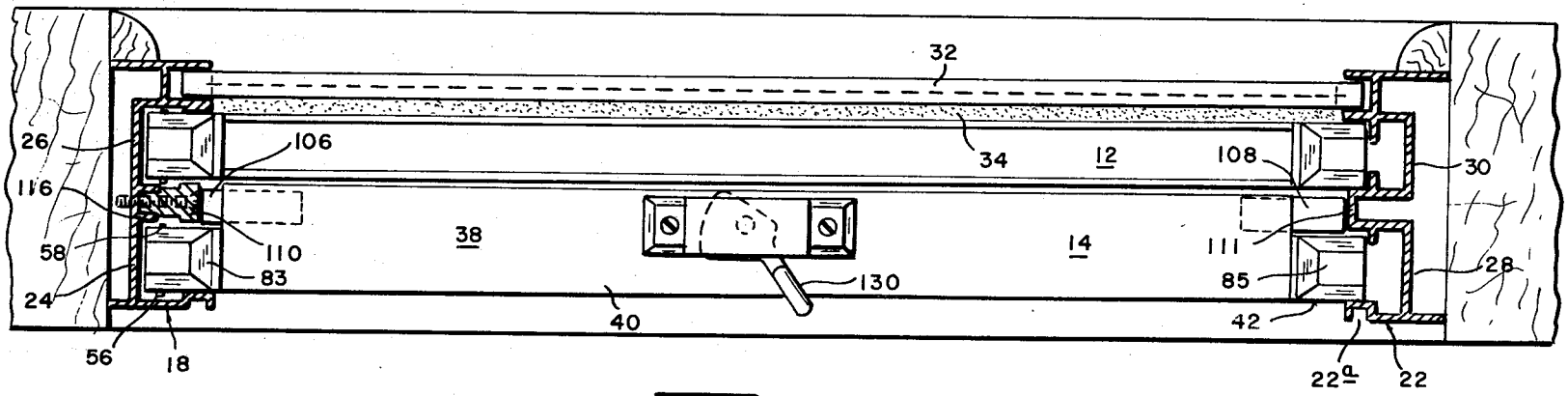
FIG. 3
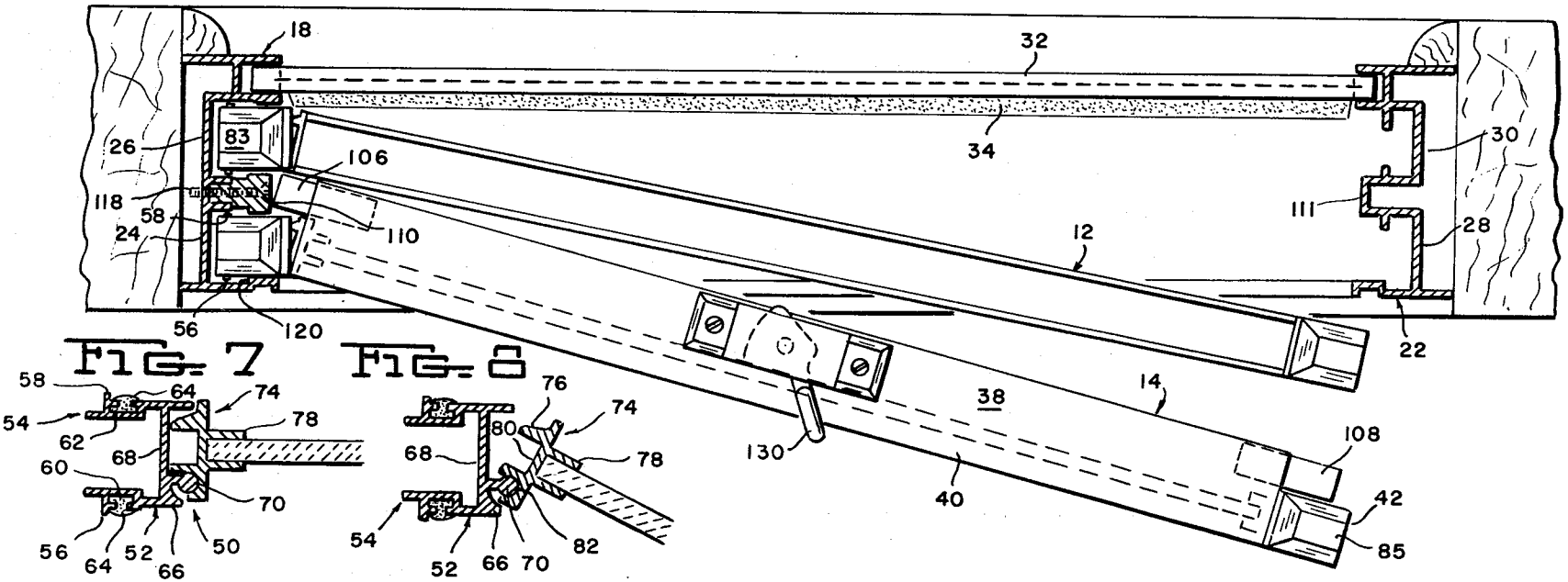
FIG. 4
FIG. 6
FIG. 7

26
118
110
102
24
116
103
105
102
54
56
18
50
76
74
83
70
64
82
52
96
98
14
99
90
92
94
119
120
100
50
40
38
12
34
32
24
102
105
83
84
92
68
50
83
40
102
103
105
84
92
68
24
98
96
90
99
94
100

WINDOW CONSTRUCTION

BACKGROUND OF THE INVENTION

Various designs of metallic windows of the sliding and swinging sash types are known. Some of such windows permit the sash to pivot inwardly of the frame about a horizontal axis while others permit swinging about a vertical axis. Other designs of metallic windows only have sliding sashes where the sashes may be removed entirely from the frame. Certain of the swinging sash window designs permit the window to be removed from the frame as well as being able to be swung away from the frame. However, removing a swinging sash from the frame in all known designs where such removal is possible is difficult at best, usually requiring a major and time consuming disassembly procedure. It is to be noted that it is desirable to be able to remove a sash from the window frame especially when it becomes necessary to replace the glass pane. Under ordinary use of the swinging type windows, it is only desirable that the windows be swung inwardly of the frame for cleaning purposes.

The present invention provides a metallic window construction wherein the slidable sashes are pivotable about vertical axes and are also selectively removable from the window frames. The pivoting arrangement of the sashes are formed from simple elements which are easily assembled to each other and economically manufactured. Likewise, the elements securing the sashes to the frames are simple in construction and economically made. Also, the elements are simply arranged to permit easy removal of the sashes from the window frame.

SUMMARY OF THE INVENTION

More particularly, the present invention provides a window construction comprising preferably a frame with jambs and sash guides; an upper and a lower sash received in the frame with at least the lower sash being upwardly and downwardly slidably received within the frame; pressure urged sash balance means disposed between the sash guides and one side of the slidable sash for retaining the slidable sash within the jambs while permitting the sash to be selectively moved against the pressure to a position where it may be rotated about a vertical axis away from the frame; the jamb adjacent the one side of the slidable sash having a vertical channel extending between its sash guides and over a major portion of the length of the jamb; a locking bar removably secured within the channel; said one side of the slidable sash having pivoting means including first and second members, one of the members having a vertical pivot pin element extending over a substantial portion of the length thereof and the other of the members having a receptical complementary in shape to the pin element, one of the members being received in the sash guide, said one member including a restraining element shaped to cooperate with the locking bar to secure the slidable sash within the frame while the locking bar is fixed to the frame. By simply pivoting the sash away from the frame and removing the locking bar, the sash may be easily and quickly removed from the frame.

In its preferred form, the sash of the window construction is formed whereby the first and second members of the pivoting means are removable from each other with the pin element and receptical being constructed and arranged to hold the members together and to permit separation from each other by moving one member longitudinally with respect to the other. The members are secured against longitudinal movement by a locking block fixed to one of the members. Thus, the members of the pivoting arrangement are simply and easily assembled or disassembled by sliding the respective members off of or onto each other and removing or fixing the locking block in place.

Various other advantages, details and modifications of the present invention will become apparent as the following description of a present preferred embodiment thereof proceeds.

BRIEF DESCRIPTION OF THE DRAWING

In the accompanying drawings I have shown a certain present preferred embodiment of the invention in which:

FIG. 3 is a sectional view looking along the line III—III of FIG. 2;

FIG. 4 is a sectional view similar to that of FIG. 3 showing both upper and lower sashes swung inwardly of the window frame;

FIG. 6 *a* is a partial section in elevation of the upper section of the sash balance and the upper left corner of the lower sash, the sash balance being restrained from upward movement so that the sash may be moved upwardly into a position such as is shown in FIG. 6; and FIG. 7 and 8 are sectional views through the pivoting arrangement of either upper or lower sash showing details of construction of the members in the unswung and swung orientation of the sash respectively.

Figure 1:
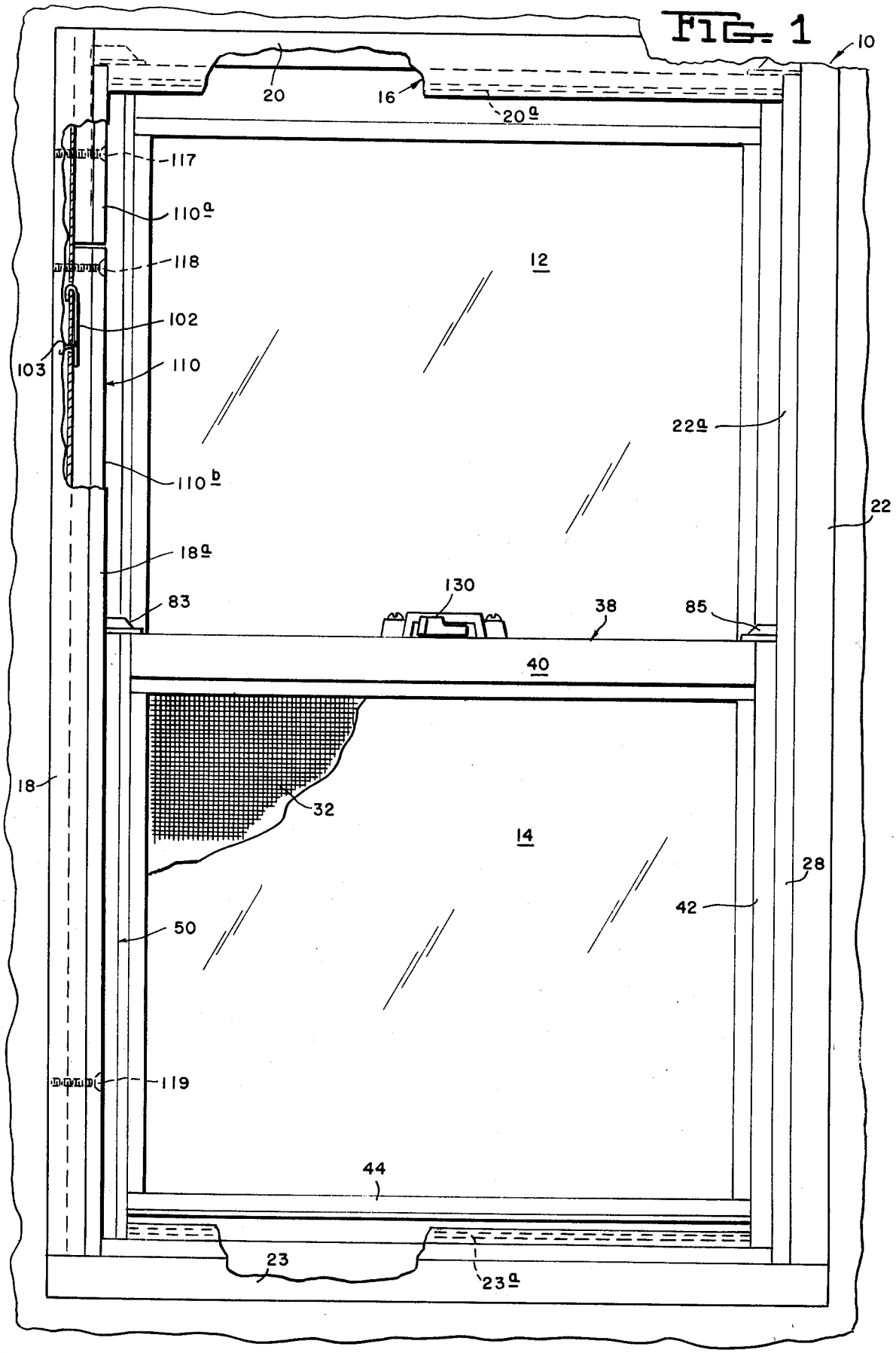
FIG. 1 is an elevation view of a metallic window with double hung slidable sashes both of which may be swung about vertical axes embodying the present invention with parts cut away to show details of construction and showing the sashes in their fully closed positions.

Referring now to the drawings, there is shown a window assembly 10 of the slidable and swinging type being double hung having an upper sash 12 and a lower sash 14. The general construction of the window assembly 10 is old and well known and includes a frame 16 formed from metallic members such as extruded aluminum. The frame 16 is comprised of suitably interconnected left jamb 18, upper section 20, right jamb 22, and lower section 23, with each section including seal strips 18*a*, 20*a*, 22*a*, and 23*a*, respectively, extending around the inner periphery of the sections.

The upper and lower sashes 12 and 14 are slidably received within the confines defined by the frame 16. The sashes are arranged to slide along sash guides 24 and 26 formed in left jamb 18 and sash guides 28 and 30 formed in right jamb 22. The sash guides are clearly shown in FIGS. 3, 4, and 5. A removable screen 32 is slidably arranged in the outer, lower section of the frame 16 between the left and right jambs 18 and 22 in suitably formed slots. Weather stripping 34 is suitably secured to the upper section of the frame of the screen 32.

Figure 2:
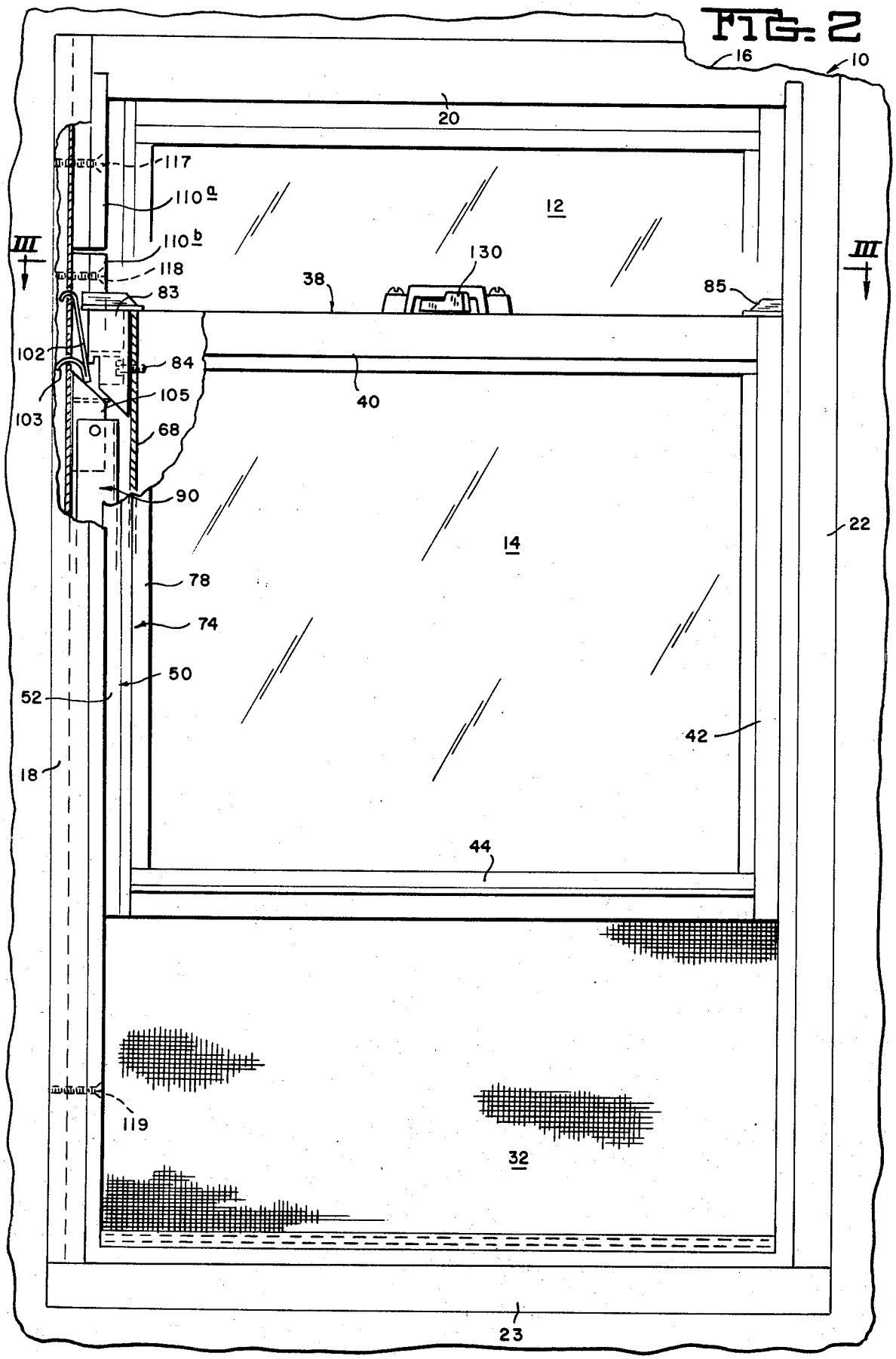
FIG. 2 is an elevational view similar to FIG. 1 showing the sash balance in a position whereby the lower sash may be moved leftwardly away from the right jamb to be swung inwardly of the window frame.
Figures 5, 6, 6A:
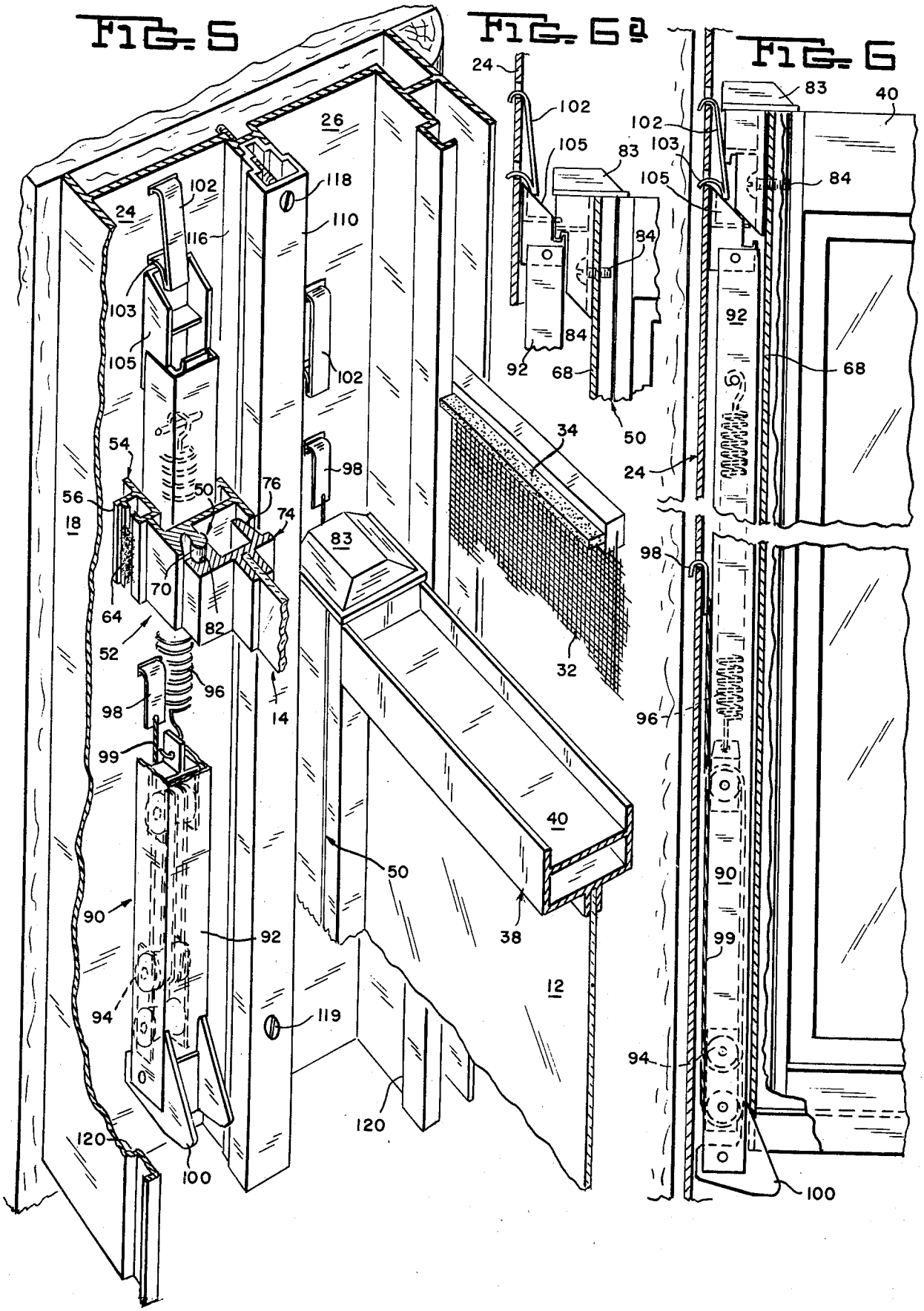
FIG. 5 is a perspective view of a portion of the window partly in section with parts cut away to show details of construction showing the sash balance, locking bar, and other elements of the window assembly.
FIG. 6 is a partial elevation view in section of the window showing details of construction of the sash balance in relationship to the lower sash with the sash being in position to be moved leftwardly for swinging inwardly of the window frame.

Each sash 12 and 14 is constructed in essentially the same way, and the lower sash 14 will be described in detail with the understanding that its description corresponds to that of the upper sash 12. The frame 38 of the lower sash 14 includes an upper section 40, right section 42, and lower section 44, all of which are of well known construction of extruded aluminum or the like. Right section 42 is shaped to slidably fit into the sash guide 28 formed in right jamb 22. The left section of the frame 38 is of unique construction and will be identified throughout as pivoting means 50 for the lower sash 14. The pivoting means 50 includes a first member 52 of extruded aluminum or the like shown in FIGS. 7 and 8, as having generally U-shape with an inner section 54 open towards the sash guide 24 of left jamb 12. The inner section 54 has a pair of opposed tabs 56 and 58 at the left end portion thereof and a pair of opposed slots 60 and 62 for receiving seal stripping 64 therein. First member 52 also includes a U-shaped outer section 66 separated from the inner section 54 by a center strip 68. A generally cylindrically shaped pivot pin 70 is formed integrally on center strip 68 and extends longitudinally over the entire length of the first member 52. The other portion of the pivoting means 50 is an extruded second member 74 having a U-shaped inner section 76 shaped to loosely fit within the confines of the outer section 66 of the first member 52. The second member 74 also includes a U-shaped outer section 78 shaped to snugly receive an edge of a glass window pane. Inner and outer sections 76 and 78 are separated by a center strip 80 having a generally cylindrically shaped receptical 82 formed thereon. The receptacle 82 is shaped complementary to the pivot pin 70. The first and second members 52 and 74 are pivotably joined and removed from each other simply by reciprocally moving the first member with respect to the second member. An insert 83 formed of a suitable plastic material is snugly and removably received within the upper portion of inner section 54 of the first member 52 and is held in place by a screw 84 extending through the mid section of the insert and into the center strip 68, as shown in FIGS. 2, 6 and 6*a*. Insert 83 secures the first and second members 52 and 74 against reciprocal movement with respect to each other. The insert 83 may be simply removed by backing out screw 84 and pulling the insert out from within the first member 52. Insert 83 is also shaped to fit loosely within the sash guide 24 and serves also to provide a smooth guide for the lower sash 14 within the left jamb 18. A similarly shaped insert 85 is fixed to an upper section of right section 42 of the frame 38 and is disposed within the sash guide 28 of the right jamb 22 to provide a smooth guide for the lower sash 14 within the right jamb. Lower sash 14 is secured in position within frame 16 by means of a sash balance 90 of well-known construction shown in detail in FIGS. 5 and 6. The sash balance 90 is disposed in sash guide 24 of left jamb 18 and includes the usual elongated housing 92 which fits snugly within the confines of inner section 54 of the first member 52 forming part of the pivoting means 50 for sash 14. Within housing 92 are the pulley system 94 connected with spring 96. The pulley system 94 is hung on the wall of the left jamb 18 by a hook 98 connected with the cord 99 forming part of the pulley system 94. The sash 14 is biased into snug relationship within sash guide 28 of right jamb 22 by cam 100 fixed to the lower end of housing 92. The cam 100 acts between sash guide 24 and the center strip 68 of first member 52 of the pivoting means 50 of sash 14. The sash balance 90 travels with the sash 14 holding it snugly within the sash guides 24 and 28. To release sash 14 for swinging it out, a spring clip 102 having a hooked lower section 103 is snapped out from its flattened position in sash guide 24, as shown in FIGS. 2, 5, 6 and 6a, so that the hooked section 103 engages the upper edge of cap 105 which is fixed to the upper end of housing 92. The sash balance 90 is thus held against upward movement with the sash 14, thereby permitting the sash to travel upwardly relative to the sash balance to a point where the cam 100 no longer acts to force the sash in the rightward direction. At that point the sash 14 may be moved leftwardly away from the sealing strip 22*a* to permit the sash 14 to be swung inwardly about its pivot means 50 as shown in FIGS. 4 and 8. Restoring sash 14 to its slidable relationship with frame 16 merely requires swinging the sash back into alignment with sash guide 28, lowering the sash onto cam 100 so that it carries the sash balance 90 downwardly, and depressing clip 102 so that it is flush with sash guide 24 as shown in FIG. 1.

Lower sash 14 is assisted in being centered in place by means of slide locks 106 and 108 of well-known construction suitably located on the top edge of the upper section 40 of frame 38 of the sash 14. The slide locks 106 and 108 also serve as a weather seal and are spring biased to urge a force for the sash 14 onto locking bar 110, shown clearly in FIGS. 3, 4 and 5, disposed centrally within left jamb 18 and onto the raised central shoulder 111 formed integrally with right jamb 22, as shown in FIGS. 3 and 4.

Locking bar 110 also serves to act in securing the lower sash 14 within the frame 16. The locking bar 110 is generally T-shaped having an upper bar 110*a* and a lower leg 110*b* which fits snugly into a channel 116 forming part of the left jamb 18. As shown in FIGS. 1 and 2, the locking bar 110 has an upper section held in channel 116 by a screw 117 and a lower section held in the same channel by a pair of screws 118 and 119. When sash 14 is fixed within the sash guides 24 and 28 of the left and right jambs respectively, the upper bar 110*a* interferes with the tab 58 on the inner section 54 of the first member 52 of pivoting means 50, and tab 56 of the inner section interferes with strip 120 form on the inner edge of the left jamb 18. When it is desired to remove the entire lower sash 14, it is swung inwardly and while the sash 14 is in a generally upper position as shown in FIG. 2, the lower section of the locking bar 110 is removed from channel 116 after screws 118 and 119 are removed. The reverse procedure is followed when returning sash 14 into fixed relationship with the frame 16.

As mentioned earlier, the upper sash 12 is constructed essentially the same as and operates the same as lower sash 14. The upper sash 12 is held in snug slidable relationship with frame 16 by a sash balance arrangement, pivots inwardly along a pivoting means 50, and is secured within left jamb 18 by a locking bar 110 and strip 120 acting in concert with tabs 56 and 58 of pivoting means 50. When removing the in-swung upper sash 12 from jamb 18 it would be lowered below the upper section of the locking bar 110.

The upper and lower sash 12 and 14 may be locked against any movement by rotating the fastener 130 on the lower sash into locking engagement with the upper sash.

It should now be clearly understood how the present invention provides the advantageous simple pivoting means structure for the sashes, which structure acts also as an element for securing the sashes within the window frame. The locking means for securing the sashes within the frame is likewise simple.

While I have described a certain preferred embodiment of this invention, it is to be distinctly understood that the invention is not limited thereto, but may be otherwise variously embodied within the scope of the following claims.

I claim:

1. A window construction comprising a frame with jambs and sash guides;

an upper and a lower sash received in said frame with at least said lower sash being upwardly and downwardly slidably received within said frame;

pressure urged sash balance means disposed between said sash guides and one side of the slidable sash for retaining the slidable sash within said jambs while permitting the slidable sash to be selectively moved against the pressure to a position where the slidable sash may be rotated about a vertical axis away from said frame;

a locking means removably secured within the jamb adjacent said one side of the slidable sash;

said one side of the slidable sash having pivoting means including first and second elongated members, one of said members having a vertical pivot pin element extending over a substantial position of the length thereof and the other of said members having a receptacle complementary in shape to said pin element, one of said members being received in a sash guide, said one member including a restraining element shaped to cooperate with said locking means to secure the slidable sash within said frame while said locking means is fixed to said frame.

2. The window construction as set forth in claim 1 wherein said first and second members are removable from each other with said pin element and receptacle are constructed and arranged to hold said members together and to permit separation from each other by moving one member longitudinally with respect to the other, and securing means removably fixed to one of said members for securing said members against longitudinal movement with respect to each other.

3. The window construction as set forth in claim 1 wherein said channel and said locking bar are constructed and arranged such that said locking means may only be detached from said frame when the slidable sash is pivoted away from said frame.

4. The window construction as set forth in claim 1 wherein said pin element is integral with the remaining portion of said one member. .

5. The window construction as set forth in claim 1 wherein said receptacle is coextensive in length with said pin element.

6. The window construction as set forth in claim 1 wherein said one member is shaped to confine said sash balance means.

7. The window construction as set forth in claim 1 wherein said locking means includes a generally T-shaped bar with the stem of the T being received in said channel; and wherein said restraining element is tab formed integrally with the remainder of said one member.

8. The window construction as set forth in claim 1 wherein said pivot pin is on said member received in the sash guide.

9. The window construction as set forth in claim 1 wherein said jamb adjacent said one side of the slidable sash has a channel formed thereon extending its sash guides and over a major portion of the length of the jamb; and wherein said locking means is an elongated bar removably secured within said channel.

* * * * *